US007077299B2

(12) United States Patent
Amidzich

(10) Patent No.: US 7,077,299 B2
(45) Date of Patent: Jul. 18, 2006

(54) DISPENSING FAUCET FOR A PRESSURIZED SOURCE

(75) Inventor: Bradford G. Amidzich, Pewaukee, WI (US)

(73) Assignee: Vent-Matic Co., Inc., Milwaukee, WI (US)

( * ) Notice: Subject to any disclaimer, the term of this patent is extended or adjusted under 35 U.S.C. 154(b) by 82 days.

(21) Appl. No.: 10/673,943

(22) Filed: Sep. 29, 2003

(65) Prior Publication Data

US 2004/0069966 A1 Apr. 15, 2004

Related U.S. Application Data

(63) Continuation-in-part of application No. 10/092,653, filed on Mar. 7, 2002, now Pat. No. 6,626,420, which is a continuation-in-part of application No. 10/016,200, filed on Dec. 13, 2001, now Pat. No. 6,457,614.

(51) Int. Cl.
*B67D 3/00* (2006.01)

(52) U.S. Cl. ..... 222/518; 222/501; 222/547; 222/564; 251/129.21; 251/122

(58) Field of Classification Search ..... 222/460.7, 222/501, 504, 509, 518, 547, 564; 251/129.21, 251/122

See application file for complete search history.

(56) References Cited

U.S. PATENT DOCUMENTS

| | | | | |
|---|---|---|---|---|
| 1,924,637 | A * | 8/1933 | Carpenter | 251/285 |
| 1,982,750 | A | 12/1934 | McCue | |
| 2,034,623 | A * | 3/1936 | Kraft | 137/170.6 |
| 2,097,063 | A | 10/1937 | Heller | |
| 2,119,250 | A | 5/1938 | Smith | |
| 2,331,527 | A | 10/1943 | Welty et al. | |
| 4,720,076 | A | 1/1988 | Hyde | |

* cited by examiner

*Primary Examiner*—Michael Mar
*Assistant Examiner*—Melvin A. Cartagena
(74) *Attorney, Agent, or Firm*—Boyle Fredrickson Newholm Stein & Gratz S.C.

(57) ABSTRACT

A faucet comprises a valve body having a bore, an inlet port and an outlet port. A plunger is disposed in the valve body and is reciprocated in the bore. The inlet port opens into a fluid passage adapted for connection to a pressurized source, and the outlet port opens into a dispensing spigot adapted to discharge materials from the faucet. A handle having a pivotal lever is disposed in the valve body and engages the plunger to reciprocate longitudinally through the bore. A plug is mounted on the plunger and has axial and radial sealing surfaces. The plug is forced against the axial valve seat when the valve is closed to deform in both axial and radial directions.

18 Claims, 7 Drawing Sheets

DISPENSING FAUCET FOR A PRESSURIZED SOURCE

CROSS-REFERENCE TO RELATED APPLICATION

This application is a continuation-in-part of prior U.S. patent application Ser. No. 10/092,653, filed Mar. 7, 2002; and subsequently issued on Sep. 30, 2003 as U.S. Pat. No. 6,626,420, which is a continuation-in-part of U.S. patent application Ser. No. 10/016,200, filed Dec. 13, 2001 and subsequently issued on Oct. 1, 2002 as U.S. Pat. No. 6,457,614. The subject matter of both prior applications is hereby incorporated by reference in its entirety.

BACKGROUND OF THE INVENTION

1. Field of the Invention

The present invention relates to faucets for use with beer tappers and other pressurized dispensers and, more particularly, relates to a faucet configured to dispense materials in a controlled manner while minimizing bacterial contamination.

2. Discussion of the Related Art

Dispensing faucets are used in a variety of applications in which materials are dispensed from pressurized containers or other pressurized sources. Dispensing faucets of this type are widely used in beverage dispensing applications in which beer, soda, or another beverage is dispensed from a pressurized container such as a keg. They are also sometimes used to dispense condiments such as relish or mustard from containers under pressure. Indeed, the applications are nearly infinite.

A typical prior art faucet includes a valve operated by a pivotal lever. Specifically, a valve element is mounted on a plunger that is slidable longitudinally through a bore. When the lever is pivoted forwardly, towards the user, to open the valve element, the valve element moves rearwardly through the bore, thereby permitting dispensed materials to flow from the inlet of the valve to the outlet. The entire valve is exposed to flowing fluid during dispensation, but when the valve is not dispensing, major portions of wet valve elements are exposed to air. In addition, fluid that collects in the front portion of the valve must be drained from the valve through a drain bore. Standing fluid in the valve and exposure of the wet valve elements to air can give rise to undesirable bacterial growth within the valve. Therefore, the need has arisen to improve the design of a faucet to eliminate air from the interior of the valve.

Another problem associated with conventional faucets is that they do not incorporate features allowing sanitary dispensation of particulate matter. As a result, if used to dispense viscous fluids or particulate-laden materials, such as mustard or relish, residues of the dispensed materials remain on the valve element after the dispensing operation, and bacteria may grow on the residual materials on the valve element, risking contamination of the dispensed materials during subsequent dispensing operations. Traditional tapper type dispensing faucets are therefore rarely used to dispense flowable materials such as condiments or other viscous or particulate-laden fluids. The need therefore has arisen to provide a dispensing faucet that incorporates measures to wipe the faucet's valve element clean of dispensed fluid during the dispensing operation.

Traditional faucets also require a fairly elaborate method for cleaning the valve elements, including taking the valve elements out of the valve body and washing them at another location. The need has arisen to not only provide valve elements that remain clean, but that also provide valve elements which can be cleaned effectively without disassembling the valve.

SUMMARY OF THE INVENTION

Pursuant to the invention, a dispensing faucet is provided with a number of advantages. The interior of the valve does not contain air. The valve element may also be configured to be wiped clean of dispensed materials when it is driven by the handle. The spigot at the outlet of the valve may also be removable for easy access to the valve element.

In accordance with a first aspect of the invention, the valve seal is provided at the outlet of the valve rather than the inlet, so that all of the valve elements are immersed in fluid at all times.

In accordance with another aspect of the invention, the plunger of the valve is configured to encourage fluid to wash over it freely.

In accordance with yet another aspect of the invention, a food-grade lubricant is sealed within a structure to prevent air from entering the valve through the lever of the handle.

In accordance with another aspect of the invention, which is not necessarily mutually exclusive with the other aspects, a rib may be molded within the valve to create a wiping action when opening and closing the valve.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, with corresponding parts in different embodiments designated by multiples of 100, and in which.

DETAILED DESCRIPTION OF THE PREFERRED EMBODIMENTS

1. Resume

Figure 2:
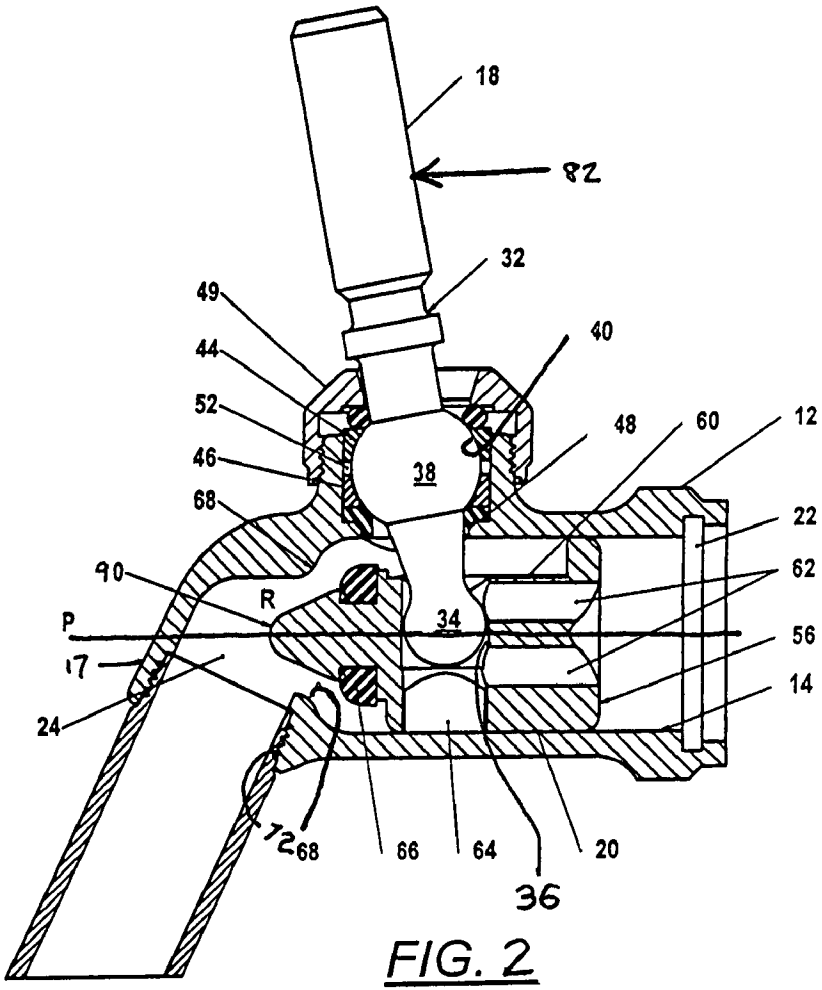
FIG. 2 corresponds to FIG. 1 and illustrates the valve in a fully open position.

A dispensing faucet is provided that is usable in any system in which a faucet is selectively operated to dispense materials from a pressurized source. For instance, it is applicable to "tapper" faucets configured to dispense beer or another pressurized liquid from a keg or another pressurized container. It is also applicable to condiment faucets configured to dispense mustard or relish from a can. For the purposes of describing this invention, both non-viscous and viscous materials, such as beer and hot dog relish, shall be considered fluids or liquids.

The faucet comprises a valve body and a plunger which is mounted in a bore in the valve body for reciprocating movement therein. The bore has an inlet port that opens into a passage adapted for connection to a pressurized container or other source of pressurized fluid, and an outlet port that opens into a dispensing spout or spigot adapted to deliver materials from the faucet. A handle having a pivotal lever is disposed in the valve body and terminates in a socket of the plunger. The lever thus engages the plunger to drive the plunger to reciprocate axially through the bore. A plug on the plunger controls flow through the valve. In a first embodiment of the invention, the interior and exterior of the plunger are designed to allow fluid to easily pass through and around the plunger. The plunger may also be constructed with a nose, or tip, downstream from the plug.

2. Construction and Operation of First Embodiment

Referring to FIGS. 1–4, a faucet 10 constructed in accordance with a first embodiment of the invention includes a valve body 12 having a bore 14 within it, a spigot 16 that is mounted on the valve body 12, and a handle 18 that is operable by an operator to translate a plunger 20 within the bore 14 to open the faucet 10 and dispense fluids through the spigot 16.

The valve body 12 may be formed from any material capable of slidably receiving the plunger and of pivotably supporting the handle. It preferably is formed from a food-grade plastic or another moldable material. The bore 14, which is essentially cylindrical in shape, is formed axially through the valve body. An inlet port 22 is formed in an upstream axial end of the bore 14 for connecting the faucet 10 to a pressurized fluid container (not shown). An outlet port 24 is formed in the opposite end of the bore 14 for delivering dispensed materials to the spigot 16. A valve 26 is located at a reduced-diameter portion of the bore 14 located adjacent or at the outlet port 24. Another bore 28 extends radially from the bore 14, through a boss 30 on the upper surface of the valve body 12, and to the outer surface of the valve body 12 for receiving the handle 18.

The lower end of the handle 18 forms a pivotal lever 32 that terminates in a ball 34 mounted in a socket 36 of the plunger 20. The lever 32 is also pivotally mounted in the second bore 28 by a pivot mount, preferably formed from a second ball 38 and a socket 40, thereby allowing a complete and free rotation of the lever 32 relative to the valve body 12. Conversely, if lever rotation is not desired, lever 32 could be squared to size just above the ball 34. Both balls 34 and 38 are preferably molded integrally with the lever 32. The lower socket 40 preferably is formed from a simple bore in the plunger 20. The upper socket 40 is formed from an upper O-ring 42, an upper bushing 44, a lower bushing 46, and another O-ring 48. The assembly is held in place by an end-cap 49 threaded onto the boss 30 so as to clamp the O-ring 42 between the end-cap 49 and the ball 38. The upper sealing ring 42 provides a barrier between the fluid in the bore 14 and the interior of the pivot mount. It is shaped generally in the shape of an inverted L when viewed in transverse cross section so as to seal against the ball 38 at the apex of the L and to seal against both axial and radial surfaces of a lower shoulder 50 in the bore 28 at the legs of the L. The bushings 44 and 46 surround the ball 38 so as to provide primary support for the lever 32. The bushings 44 and 46 do not meet directly, but together with the ball 38, encase a quantity of food-grade lubricant 52. This arrangement provides a number of advantages. First, the lubricant 52 lubricates the lever 32 within the bushings 44 and 46 to provide smooth movement of the lever 32. Second, the lubricant 52 provides a high-viscosity barrier against the admission of air into the bore 14. Finally, the manner in which the lubricant 52 is captured between the bushings 44 and 46 and provides both of the above advantages without fear that lubricant will become intermingled with the fluid being dispensed.

The plunger 22 comprises a generally cylindrical molded member slidably mounted in the bore 14. It includes an outer peripheral surface 54 and upstream and downstream axial ends 56, 58. The above-described socket 36 extends radially into the plunger 20 between the ends 56 and 58. The entire plunger 20 is arranged within the bore 14 such that, unlike prior art faucets, nearly the entire plunger 20 is always immersed in the liquid being dispensed, even when the faucet 10 is not in use. This is advantageous because no part located within the bore 14 is exposed to air when constantly surrounded by fluid.

The plunger 20 of this embodiment is contemplated for use with a non-viscous fluid, such as beer or another beverage. The plunger 20 is therefore configured to facilitate fluid flow through and past the plunger and the interface between the plunger 20 and the lever 32 so that the plunger 20 is washed clean of any particulate matter during dispensing. Towards this end, channels 60 are formed on its peripheral surface to provide a fluted appearance, and passages 62, 64 extend from the socket 36 to upstream axial end 50 and the lower radial surface of the plunger 20, respectively. The passages 62 and 64 allow the fluid being dispensed to wash over the interior of the plunger 20, including its radial socket 36. Likewise, the channels 60 provide for fluid motion around the plunger 20.

Figure 1:
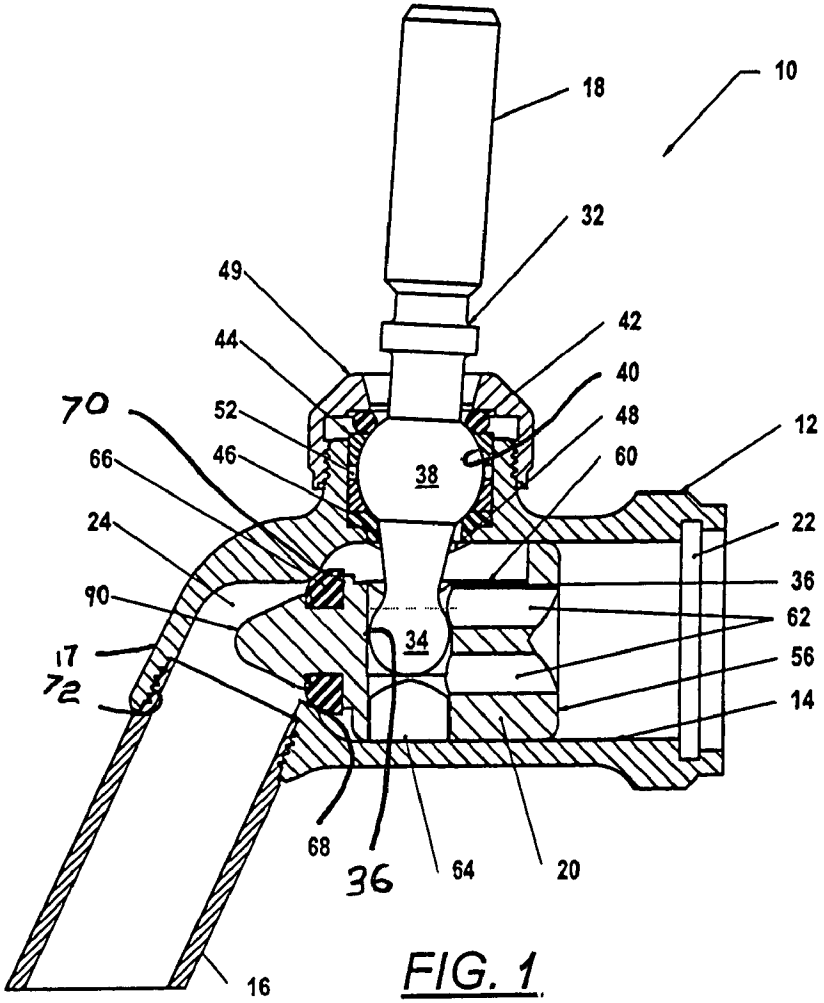
FIG. 1 is a partially sectional side elevation view of a dispensing faucet constructed in accordance with a first preferred embodiment and illustrating a valve thereof in its closed position.

A seal 66 is mounted on the downstream end portion of the plunger 20 for sealing against a valve seat 68 on the valve body 12 when the plunger 20 is in the valve-closed position of FIG. 1. The seal 66 is made of a deformable elastomeric O-ring (on the order of 70–90 durometer) that fits snugly in a groove 70 on the outer surface of the plunger 20. The seal 66 is preferably D-shaped when viewed in transverse cross section so as to present a relatively large mass for pressing against the valve seat 68. The mating surface of the valve seat 68 has a curved shape that generally complements the curvature of the seal 66. Because the seal 66 is highly deformable, it compresses axially and expands radially against the valve seat 68 to seal over a relatively large area, thereby providing a remarkably effective seal. The dual compression of the seal 66 also inhibits bacterial growth in the faucet 10 by preventing air and liquid flow through the outlet port 24 when the faucet 10 is closed.

As can be seen by reference to the Figures, three separate embodiments of the faucet are illustrated in addition to the features already discussed. The embodiments of FIGS. 1–4 are primarily directed toward the dispensation of carbonated beverages, and include a tip or nose provided on the downstream end 58 of the plunger 20. Providing a tip at this location can produce a distinct advantage when the liquid to be dispensed is carbonated.

Specifically, it has been discovered that liquid falling vertically through the spigot 16 is accelerated by gravity relative to the horizontally-flowing liquid exiting the valve. As a result, a pressure differential can form between a lower pressure region in uppermost portion of the faucet and a higher pressure region in the spigot. The pressure differential is noted with line P in FIGS. 2–4. The result of the differential pressure above and below line P can be trapping a pocket of air in the horizontal portion just downstream of the plunger, noted as R in FIGS. 2–4. At relatively high dispensing rates (on the order of over 1 gallon per minute and higher), forced liquid flow through the trapped air pocket can cause enough disruption in the fluid to separate the $CO_2$ from a carbonated liquid. The release of $CO_2$ at the outlet 24 can lead to substandard pouring of a beverage due to excessive foam in the spigot and can adversely affect the quality of the dispensed beverage. It has been found that a tip in the end of the plunger prevents the $CO_2$ from separating from the dispensed beverage for reasons detailed below. The optimal shape and extent of the tip may vary from application to application depending on, for example, the $CO_2$ content of the liquid being dispensed, the volumetric flow rate of the dispensed liquid, the throw of the handle, etc.

In each of these embodiments, a tip 90, 190, 290 is provided on the end of the associated plunger 20, 120, 220 so as to extend past the valve seat 68, 168, 268 even when the valve is in its open position. The tip of each embodiment may be formed from the same material as the associated plunger and is preferably formed integrally with the associated plunger. All of the remaining components of each of these embodiments, including the remainder of the plunger 20, 120, 220, the seal 66, 166, 266, and the handle 18, 118, and 218 are identical to one another and are, therefore, designated by the same reference numerals, incremented by 100.

Turning first to FIGS. 1 and 2, a tip 90 is formed on the downstream end of plunger 20 of a faucet 10 so as to extend past the valve seat 68 by a substantial distance even when the valve is in the open position. The tip 90 is configured to effect a relatively large pressure increase in what would otherwise be the low pressure region R of the faucet and, therefore, is well-suited for use in low flow rate applications on the order of, e.g., less than 1 gal./min. (assuming that all other factors affecting foaming are equal and/or not of concern to the designer). Specifically, the tip 90 is generally conical, has a relatively wide base at its upstream end, and is relatively long. Due to the presence of the tip 90, the pressure differential across the plane P is reduced significantly to allow the air to be evacuated from the valve by liquid flowing out of the valve. The dispensed liquid is able to flow out of the outlet 24 of the faucet 10 without allowing $CO_2$ to break out.

Figure 3:
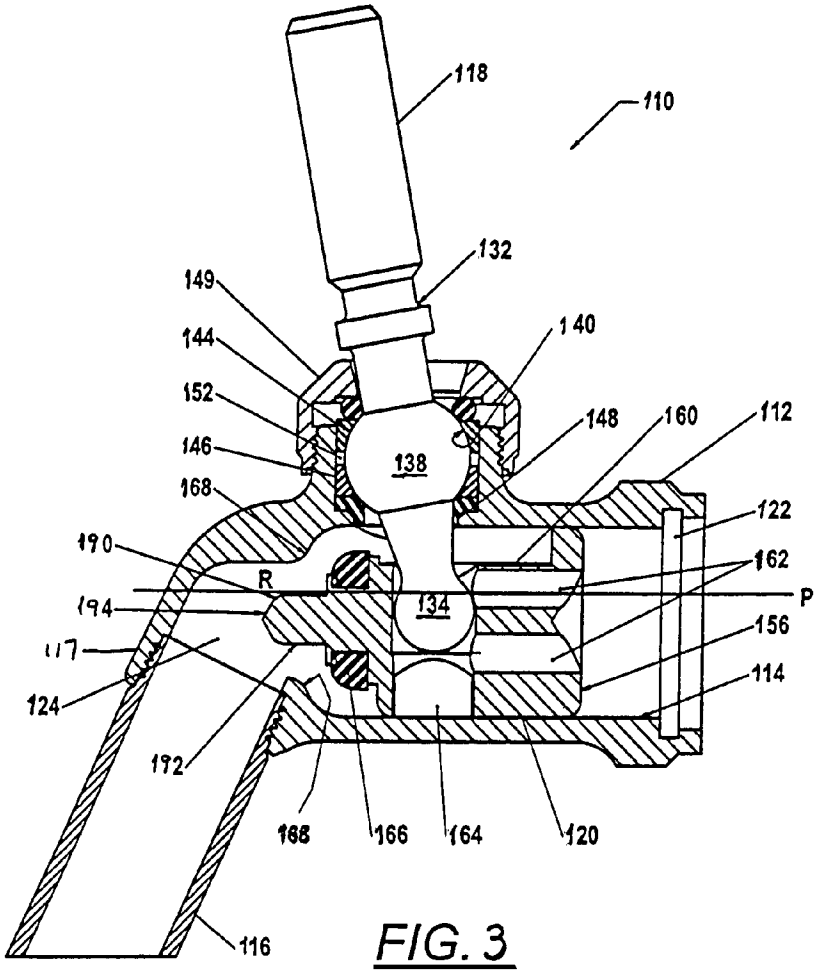
FIG. 3 is a partially sectional side elevation view of a dispensing faucet constructed in accordance with a first variant of the first embodiment and also illustrating a valve thereof in its open position.

The variant of FIG. 3 features a tip 190 that provides a lower pressure increase in the region R than the tip 90 of FIGS. 1 and 2. The tip 190 is commensurate in length with the tip 90 but has a cylindrical upstream end portion 192 and a conical downstream end 194. The cylindrical portion 192 has a considerably smaller diameter than the base of the tip 90 of the embodiment of FIGS. 1 and 2.

Figure 4:
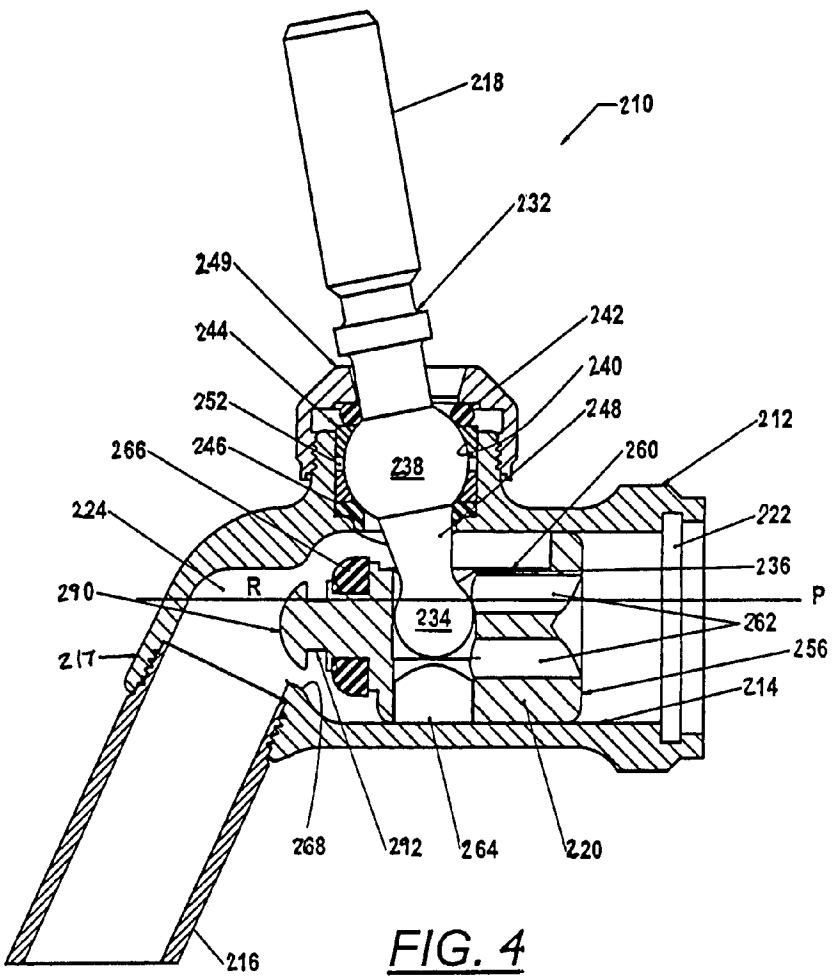
FIG. 4 is a partially sectional side elevation view of a dispensing faucet constructed in accordance with a second variant of the first embodiment and again illustrating a valve thereof in its open position.

The variant shown in FIG. 4 differs from the variant of FIGS. 1 and 2 only in that its tip 290 is somewhat bulbous in shape and has an annular groove 292 cut in its outer periphery. The bulbous tip 290 does not extend as far into the outlet 224 as tip 90 of FIGS. 1 and 2. In addition, the groove 292 is positioned so as to be essentially coplanar with the valve seat 268 when the valve is in the open position shown in FIG. 4, thus increasing the flow area at the throat of the valve and also imparting directional changes to liquid flowing through the throat.

Generally speaking, providing a tip on the plunger retains the advantages of sanitary fluid flow and ease in cleaning as previously discussed, yet also prevents the fluid disruption that can cause $CO_2$ release. It would also be possible to change the shape of the outlet so that it provides a smaller area into which the liquid is dispensed, however that solution would not provide the option of using different tips to provide different flow rates as desired. It will be obvious that each of the three tips disclosed can be modified without departing from the invention and can be used in combination with each of the other embodiments and variations discussed herein depending on the desired end result.

An additional feature of the first embodiment is the manner in which spigot 16 is connected to body 12. Referring to FIGS. 1 and 2, it can be seen that spigot 16 comprises a cylindrical tube removably mounted on the downstream end of the valve body 22, preferably by being threaded into a threaded opening 72 in the downstream end of the valve body 12. The spigot 16 connects with a downward turning connection portion 17 that can be formed integral with valve body 12. Removal of the spigot 16 renders all components of the faucet 10 that are exposed to fluid but not permanently immersed in it (namely, the valve seat 68, the downstream end 58 of the plunger 20, the end of the seal 66, the interior of the opening 72, and, if present, the tip 90) accessible for easy cleaning by a simple swab or sprayer. It also permits the spigot 16 to be removed and replaced with another spigot that is optimized to dispense a different liquid of different flow characteristics than that for which the spigot 16 is optimized.

In use, an operator opens the faucet 10 by moving the handle 18 in the direction of the arrow 82 in FIG. 2 from the position illustrated in FIG. 1 to the position illustrated in FIG. 2. This movement drives the lever 32 to pivot about its mount 40 and drive the plunger 20 within the bore 14 to the open position shown in FIG. 2. The seal 66 moves away from the valve seat 68 at this time, permitting fluid to flow out of the bore 14 and through the spigot 16. Fluid flows over, past, and through the plunger 20 via the channels 60 and passages 62, 64, thereby washing the interior and exterior surfaces of the plunger 20 free from contaminants. When the operator wishes to cease dispensing, he or she simply pushes the handle 18 back to the position shown in FIG. 1, thereby driving the plunger 20 to a position in which the seal 66 deforms against the valve seat 68 to close the faucet 10. The portions of the faucet 10 that are exposed to air can be periodically cleaned simply by removing the spigot 16 and cleaning those portions with a swab or a sprayer.

3. Construction and Operation of Second Embodiment

Figure 5:
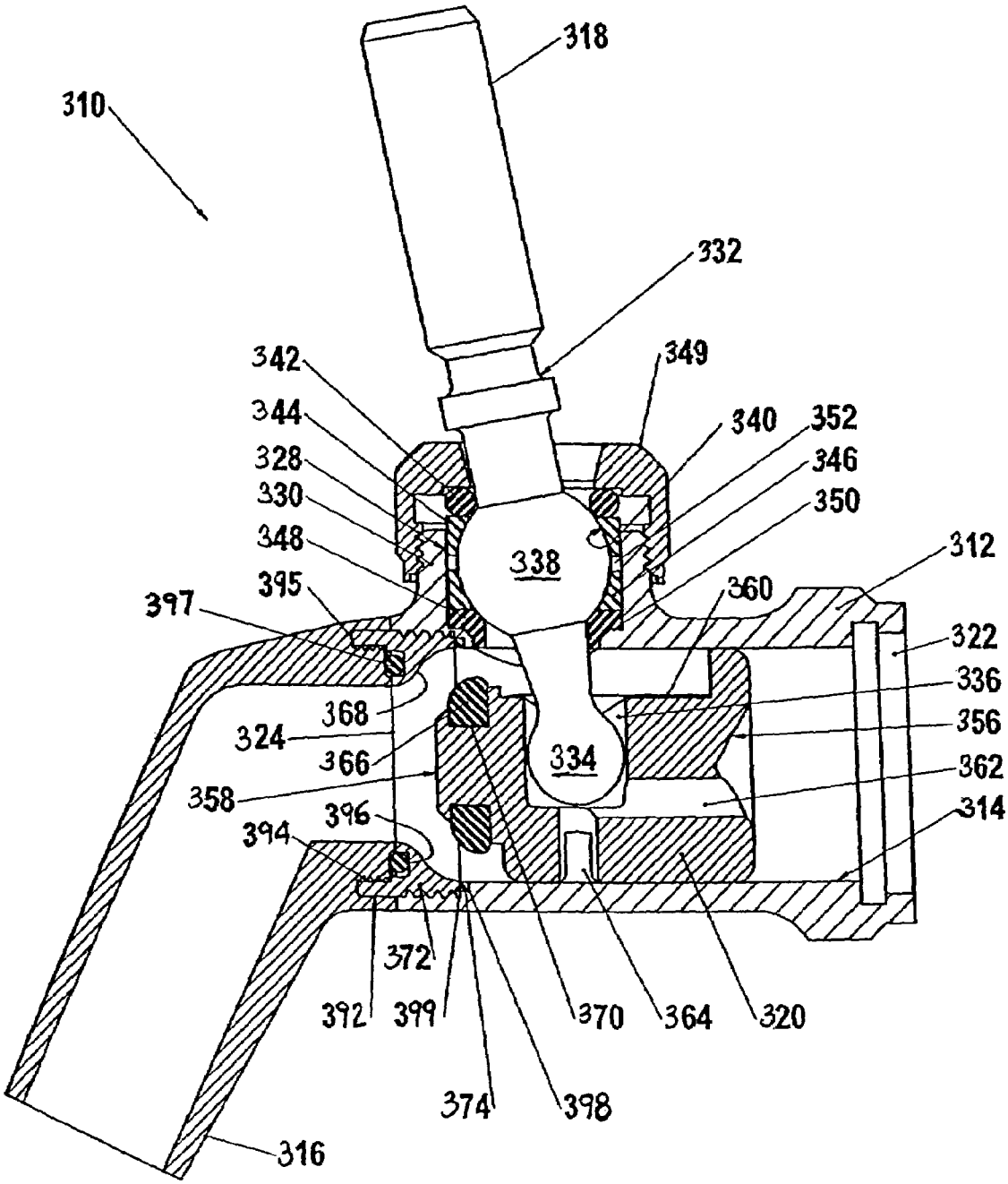
FIG. 5 is a partially sectional side elevation view of a dispensing faucet constructed in accordance with a second preferred embodiment of the present invention and illustrating a valve thereof in a fully open position.
Figure 6:
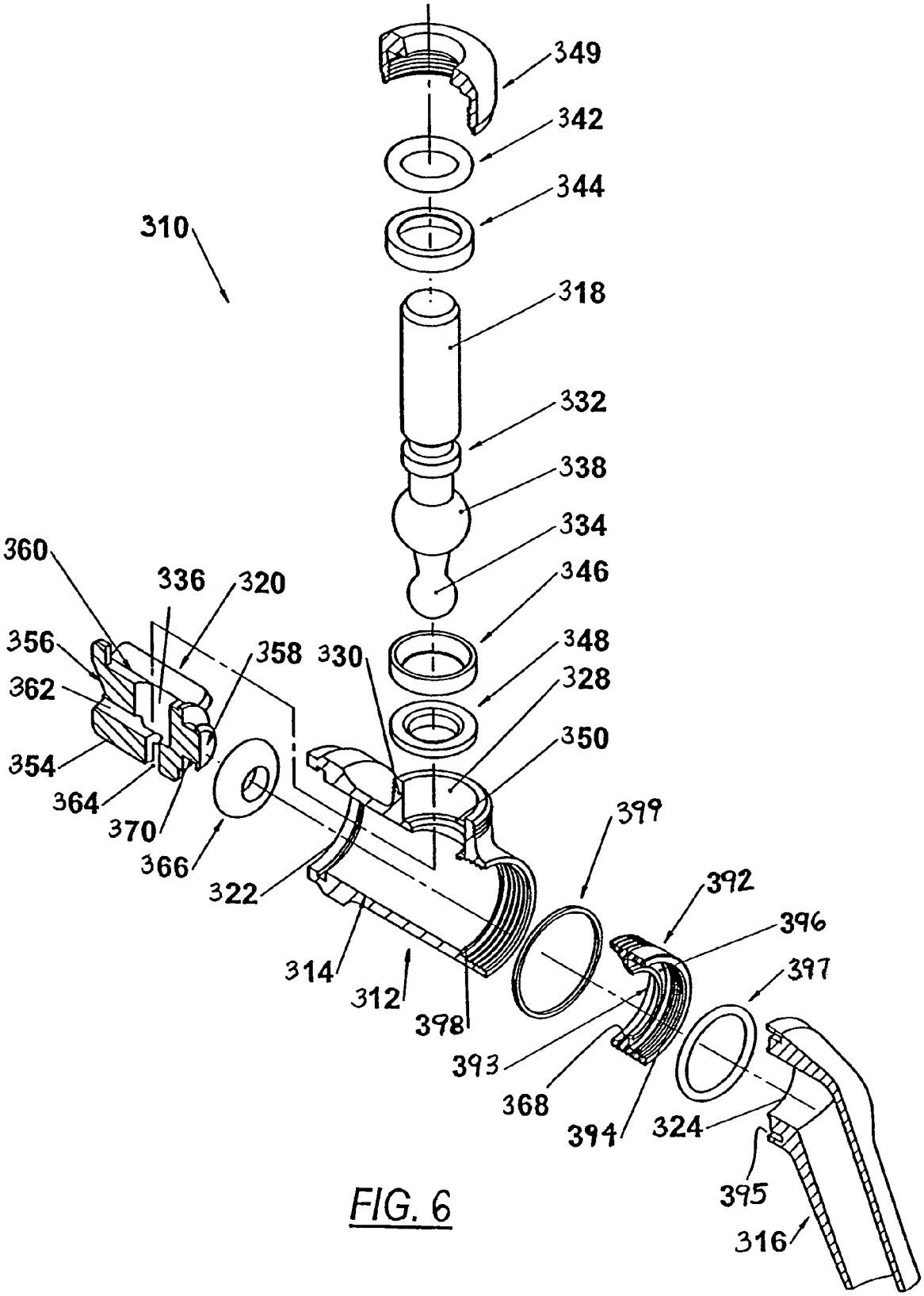
FIG. 6 is an exploded perspective view of the faucet of FIG. 5.

Referring now to FIGS. 5 and 6, a second embodiment is illustrated, which may be used in conjunction with any of the other embodiments herein. The faucet 310 therefore has many of the same components as faucet 10, and reference numbers are incremented by 300 to reflect corresponding parts. Faucet 310 therefore comprises a valve body 312 having a bore 314. At either end of the bore 314 are an inlet port 322 and an outlet port 324. The plunger 320, handle 318, lever 332, and pivot mounts 334, 336, 338, etc., are all identical to the corresponding components of the first embodiment. In fact, the primary difference between the faucet 310 of this embodiment and the faucet 10 of the first embodiment is that it is configured to adapt a generally axially oriented faucet to accept the simple cylindrical spigot disclosed above.

Specifically, as shown in FIGS. 5 and 6, the outlet port 324 features a spigot adapter 392 that is connectible with the valve body 312 and the spigot 316. The adapter 392 comprises a ring having an externally threaded upstream end portion 393 and externally threaded downstream end portion 394. The threads on the upstream end portion 393 mate with corresponding threads on the inner periphery of the downstream end of the valve body 312. The threads on the downstream end portion 394 mate with corresponding threads in a groove 395 formed in the axial end of the spigot 316. The inner periphery of the adapter 392 is stepped approximately midpoint of the adapted to present an annular surface 396 against which the spigot 316 abuts. The spigot 316 is sealed to the adapter 392 at the surface 396 via first O-ring 397, and the upstream end 393 of the adapter 392 is sealed against a shoulder 398 of the valve body 312 by another O-ring 399, thereby providing a fluid-tight flow path for the dispensing of fluid through the spigot 316. Finally, a valve seat 368 that is identical to the valve seat of the first embodiment is formed on the inner periphery of the adapter 392 upstream from the surface 396.

The adapter 392 permits the spigot 316 and adapter 392 to be removed and replaced by a different spigot and adapter arrangement having a different minimum bore diameter (formed by the diameter of the valve seat and the corresponding diameter of the bore in the spigot), thereby configuring the faucet 210 for dispensing fluid at a different rate. It is advantageous to be able to remove and replace the spigot not only for access to the plug for cleaning, as discussed above, but also to provide variable tapping conditions for various fluids.

4. Construction and Operation of Third Embodiment

Figure 8:
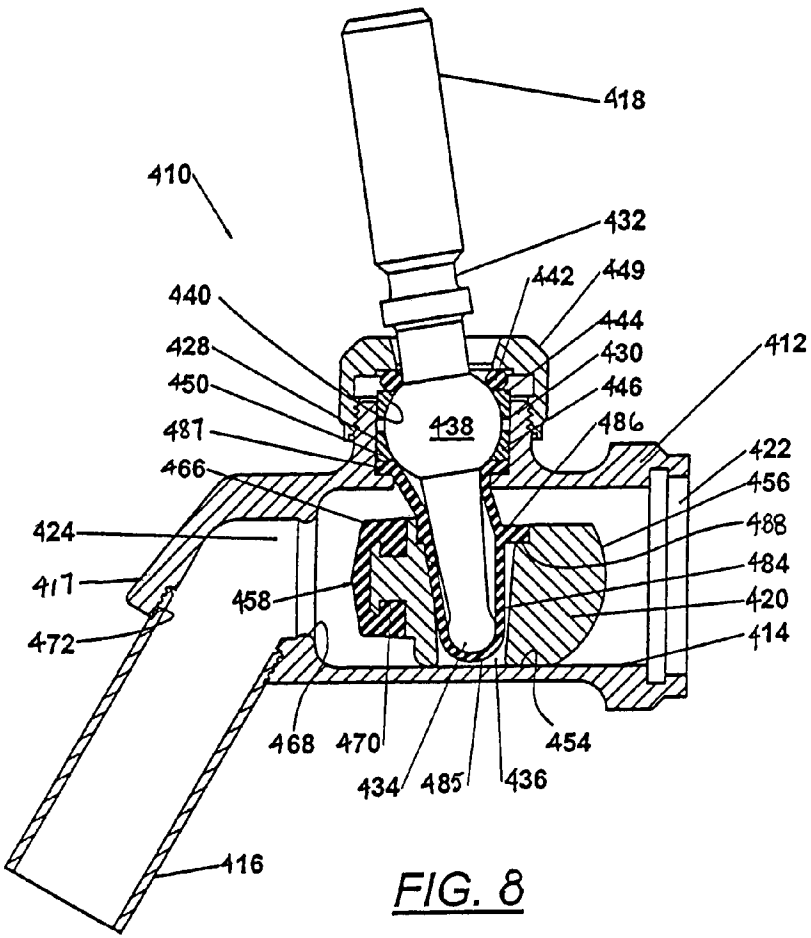
FIG. 8 corresponds to FIG. 7 and illustrates the valve in a fully open position.
Figure 7:
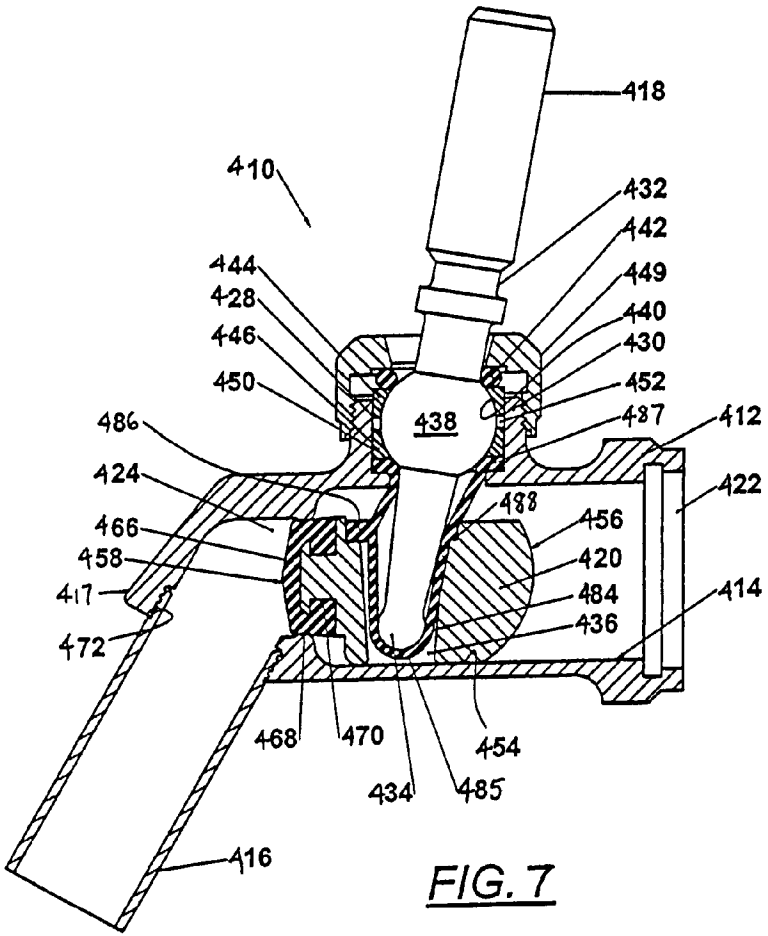
FIG. 7 is a partially sectional side elevation view of a dispensing faucet constructed in accordance with a third preferred embodiment of the present invention and illustrating a valve thereof in a closed position.
Figure 9:
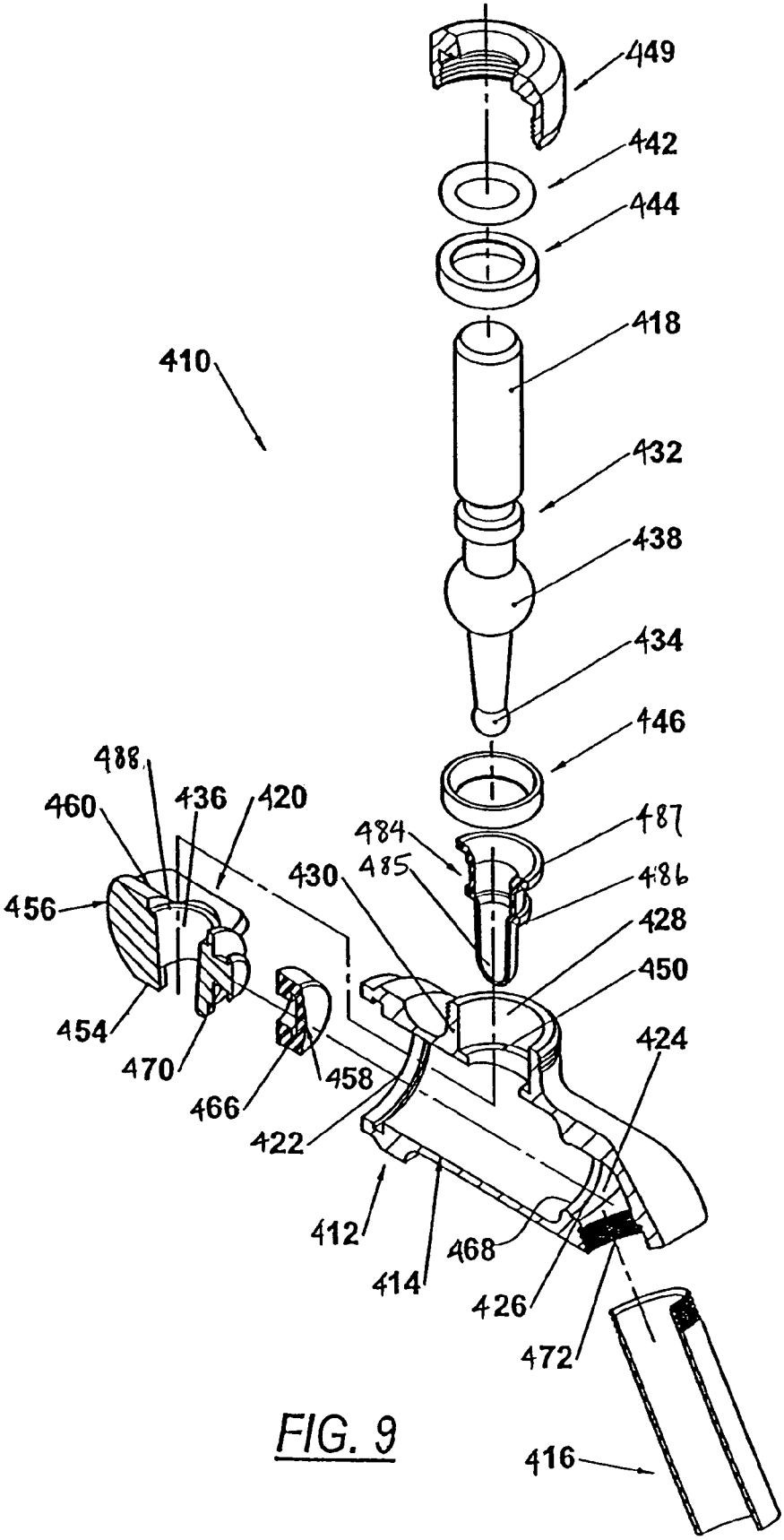
FIG. 9 is an exploded perspective view of the faucet of FIG. 8.

Referring now to FIGS. 7–9, a third embodiment 410 of the invention is illustrated which is well-suited for use with viscous and/or particulate laden fluids, such as condiments. Several of its components therefore are modified to obtain more ideal anti-bacterial dispensing of those fluids. However, it should be emphasized that faucets 10 and 410 may be used interchangeably for either viscous or non-viscous fluid dispensation, and faucet 410 has many of the same components as faucet 10 and shares many of the same beneficial characteristics. In order to reflect this similarity, parts of this embodiment that correspond to parts of the first embodiment are designated by the same reference numerals, incremented by 400. Faucet 410 therefore includes a valve body 412, axial and radial bores 414 and 428, an inlet port 422, and an outlet port 424 having a valve seat 468. As before, the bore 414 contains a plunger 420 with a valve seal 466 attached at the outlet end of the plunger 420. The handle 418, pivotal lever 432, pivot ball 438, and receiving radial socket 440 (including the O-ring 442, bushings 444 and 446, grease 452, and cap 449) are also the same as in the previous embodiment. The spigot 416 is also detachably mounted on a threaded opening 472 of the valve body 412 as in the first, second, and third embodiments.

The third embodiment is identical to the first embodiment in that the body 412 includes an integral downward turning portion 417. Portion 417 thus bears threaded opening 472 and spigot 416 is a simple cylindrical spigot. Naturally, a simple cylindrical spigot of this type may be used in conjunction with any of the other embodiments and variations of the present invention. The ability to remove and replace spigot 416 without removal of the entire faucet 410 allows the user to select a spigot of a different bore diameter in any of the preceding embodiments, thus maximizing the suitability of the faucet 410 for use with the particular fluid being dispensed.

In addition, the third embodiment includes additional features specific to dispensation of viscous or particulate-laden fluids. Because viscous fluids must be pushed through an area rather than flowing freely, the plunger 420 of this embodiment does not feature the narrow channels and passages of the prior embodiment, but rather is configured to prevent viscous fluid from entering crevices where it can be trapped. The plunger 420 is otherwise of generally the same construction as the plunger of the first embodiment, including upstream and downstream axial ends 456, 458, outer peripheral surface 454, and radial socket 436 for receiving the lower ball 434 of the lever 432. However, in order to accommodate a boot 484 (detailed below), the socket 436 is deeper than the corresponding socket of the first embodiment and may even be formed from a simple through-bore as illustrated. In addition, the front axial end 456 is preferably rounded when viewed in transverse cross-section to facilitate the flow of viscous fluids past the plunger 420.

In order to prevent fluid from entering the socket 436, the connection between the pivotal lever 432 and the socket 436 is protected by a guard or boot 484. The boot 484 is designed so as to completely isolate the lever 432 from the valve body 412 and to perform the functions of the sealing ring of the first embodiment. It is preferably a flexible food-grade elastomeric material and is preferably molded as a single piece. It completely covers the portion of the lever 432 extending downward from the pivot mount 438, 440. The guard 484 has a lower cup portion 485 receiving the terminal end of the lever 432, a center sealing lip 486 covering the socket 436, and an upper sealing flange 487. The upper sealing flange 487 is the same shape and performs the same functions as the sealing ring of the first embodiment. The center sealing lip 486 seals against a shoulder 488 formed from a counterbore in the outer radial surface of the plunger 420. The cup portion 485 is dimensioned relative to the lever 432 such that, upon faucet assembly, the bottommost end of the lever 432 engages and distorts the bottom end of the cup portion 485, thereby pulling the center sealing lip 486 into tight sealing engagement with the shoulder 488 on the plunger 420. The deformation becomes greater when the handle 418 is pivoted to open the faucet 410, thereby pulling the center sealing lip 488 even more tightly against the plunger 420 and preventing fluid from entering the socket 436 during the pivoting movement of the lever 432. While a unitary guard 484 is disclosed in the preferred embodiment, it should be understood that the sealing functions of the guard 484 could be duplicated with a pair or series of sealing rings and related structures.

Other modifications that can be made to facilitate a cleaner dispensing process when using the faucet 410 of the present invention with viscous fluids include a valve seal 466 of a different shape and the addition of an annular rib at the valve seat 468. As seen in the drawings, the valve seal 466 can be a cap-like seal having a longer axial surface than the ring-shaped seal of the first embodiment. The annular rib 468 is preferably integrally molded with the valve body 412. The modification of the seal 466 and the addition of the rib 468 provide the advantage of wiping the seal 466 clean along with providing the sealing function, discussed supra. Specifically, as the plunger 420 is pushed toward or away from the seat 468, the sides of the seal 466 scrape against the rib 468. Dispensed materials are thus pushed out of the faucet 410, while undispensed materials are scraped upstream. The axial sealing engagement of the elastomer seal 466 against the rib 468 therefore prevents materials from ever being anywhere but on one side or the other of the rib 468. Undispensed materials remain out of contact with the air, minimizing the potential for microbial growth. Meanwhile, the radial sealing engagement of the elastomer seal 466 prevents leakage of air or fluid into or out of the faucet 410.

Another advantage of the seal 466 of this embodiment is that, like the prior embodiment, because the seal 466 is engaged at the outlet port 424 and is easily accessible upon removal of the spigot 416, excess condiment or other dispensed fluid can easily be wiped from the seal 466 after unthreading the spigot 416 from the valve body 412.

5. Construction and Operation of Fourth Embodiment

In the previously-described embodiments, a substantial volume of fluid is trapped upstream of the plunger when the faucet is closed. This may be problematic in some applications, such as low duty cycle applications and/or applications in which the faucet is subject to high thermal exposure for prolonged periods of time, in that the temperature of the trapped fluid may increase to the point that the $CO_2$ will break out of solution, resulting in the dispensing of a spurt of foam upon opening of the faucet.

Figure 10:
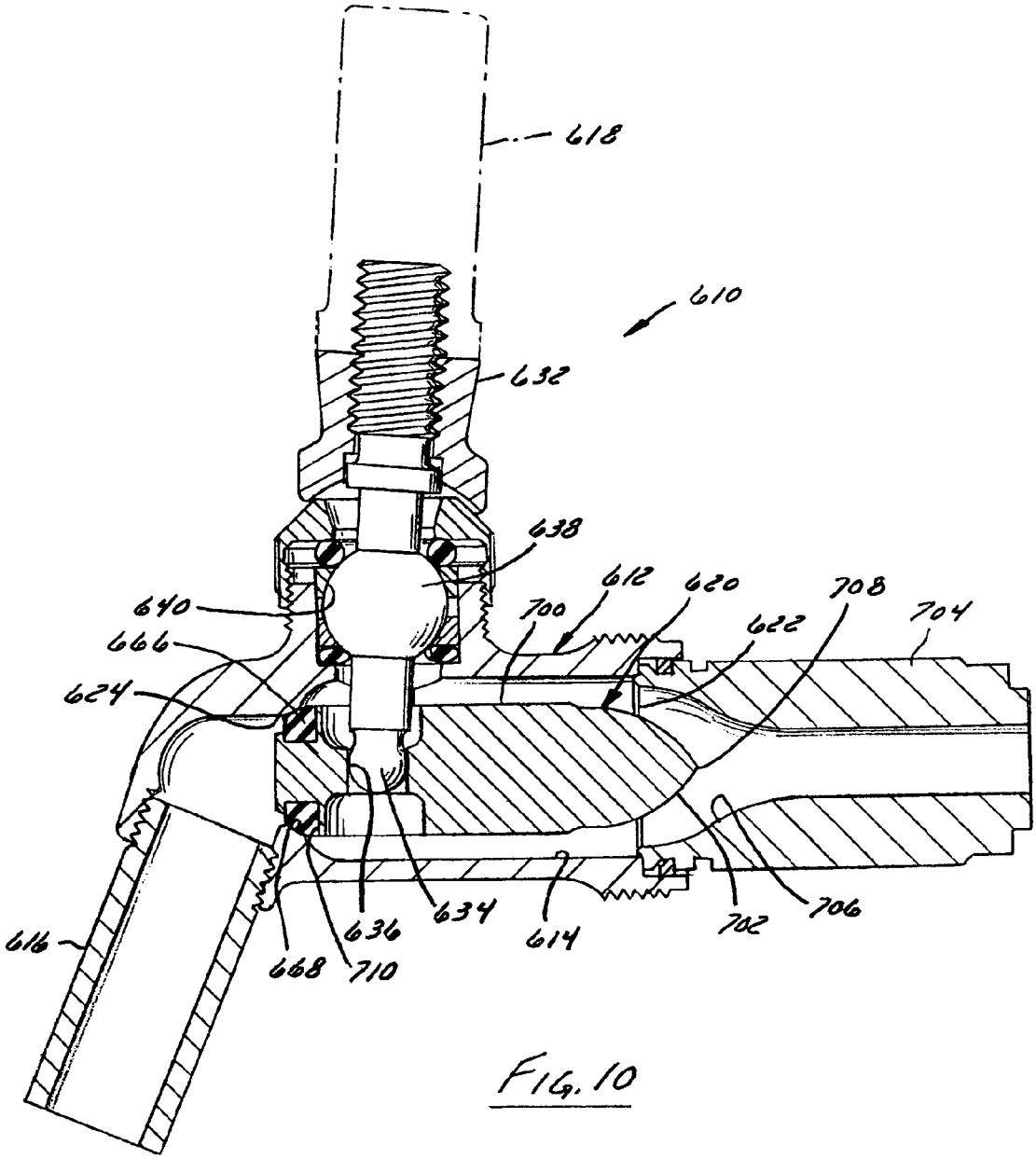
FIG. 10 is a sectional side elevation view of a dispensing faucet constructed in accordance with a fourth preferred embodiment of the present invention and illustrating a valve thereof in a closed position.
Figure 11:
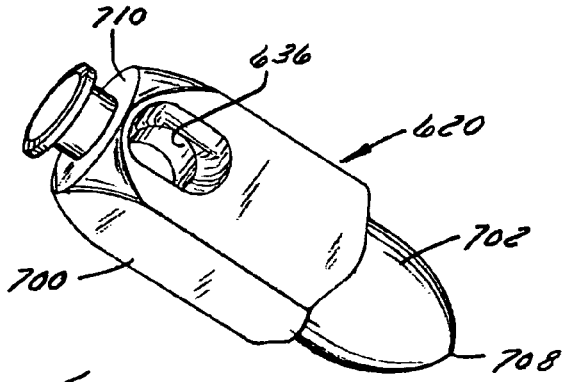
FIG. 11 is a perspective view of a plunger of the faucet of FIG. 10

This effect can be reduced by replacing the plunger of the previous embodiments with one which, when compared to those plungers, is longer and better configured for conductive heat transfer from cooler fluid upstream of the faucet to fluid trapped in the interior of the valve body. A faucet 610 having a plunger 620 suitable for this purpose is illustrated in FIGS. 10 and 11. Except for incorporating a different plunger 620, the faucet 610 is otherwise conceptually identical to the faucet 10 of the first embodiment. It therefore includes a valve body 612 having a bore 614. At either end of the bore 614 are an inlet port 622 and an outlet port 624. The plunger 620, described in more detail below, is actuated by a handle 618 via a lever 632 and pivot balls 634 and 638 that cooperate with sockets 636 and 640 as described above. A seal 666 is carried on the downstream end 710 of the plunger 620 and seats against a seat 668 when the faucet 610 is in the closed position of FIG. 10.

Still referring to FIGS. 10 and 11, the plunger 620 of this embodiment has a body 700 and a tapered extension 702 on its upstream end. (The plunger 620 is shown without a proboscis on its downstream end, but one could be provided, if desired.) As best seen in FIG. 11, the body 700 is generally square when viewed in transverse cross section. The extension 702 extends upstream from the valve body 612 and into the interior 706 of a shank 704 to which the valve body 612 is connected. The shape of the extension 702 may vary, and preferably is configured to closely resemble or match the shape of the interior 706 of shank 704. The extension 702 thus fills a substantial portion of the volume of the downstream end of shank interior 706 while still permitting fluid to flow past the extension 702 and through the bore 614 when the faucet 610 is open. In the illustrated embodiment, the extension 702 is shaped generally like a bullet or acorn. Hence the extension 702 is generally circular in transverse cross section and is tapered so as to decrease progressively in diameter from a maximum diameter at the downstream end thereof that is nearly as wide as the body 700 to a point or tip 708 at the upstream end thereof.

Still referring to FIG. 10, the plunger 620 is elongated when compared to the plunger 120 of FIGS. 1 and 2. In fact, the length of the plunger 620 of the illustrated embodiment, from the tip 708 of the end of the extension 702 to the downstream end 710 of the body 700, is approximately 1.5 inches, as compared to approximately 0.65 inches of the plunger 20 of the embodiment of FIGS. 1 and 2. The plunger 620 therefore fills a much larger percentage of the volume of the bore 614 than the plunger 20 of the first embodiment. As a result, a relatively small volume of fluid is trapped within the valve body 612. In addition, conductive heat transfer between the extension 702 and the relatively cool fluid in the shank interior 706 permits the body 700 to cool that fluid which is trapped in the valve body 612 sufficiently to maintain the temperature of that fluid at a sufficiently low value to prevent the $CO_2$ from breaking out of solution.

Another advantage of this as well as the previous embodiment is that the plunger 620 is borne solely by the perimeter of the bore 614 as opposed to a stepped extension on the upstream end and/or downstream end of the bore. As a result, the faucet 610 cannot freeze or be locked even if it is unused for extended periods of time. Conversely, in conventional faucets that have plungers borne at least in part by extension in the bore, fluids may evaporate in the extension of the bore, leaving residues that fuse the plunger to the extension of the bore.

While the present invention has been described and illustrated in connection with preferred embodiments, the scope is not to be limited by such description and illustration, but is to be limited solely by the scope of the claims, which follow. Certain equivalents will also appear to those skilled in the art, all of which are deemed to be within the scope of the present invention.

I claim:

1. A faucet comprising:

(A) a valve body having a bore that has axially aligned inlet and outlet ports and having a seat disposed adjacent said outlet port;

(B) a shank to which the valve body is connected, said shank having an inlet, an outlet opening into said inlet of said valve body, and an interior passage having at least a downstream portion that terminates at said outlet of said shank and that is radially aligned with and that opens into said inlet port of said valve body;

(C) a plunger disposed in said valve body between said inlet port and said outlet port, wherein said plunger has an upstream end and a downstream, free end, and wherein said plunger is moveable axially within said bore, in a direction parallel to fluid flow, from a valve-open position to a valve-closed position, an extension being located on said upstream end of said plunger and having a free upstream end that forms said free end of said plunger and that extends into said downstream portion of said passage in said shank when said plunger is in both said valve-open position and said valve-closed position; and (D) a valve seal mounted on said plunger, wherein said seal seals against said seat when said plunger is in said valve-closed position and is spaced from said seat when said plunger is in said valve-open position, and wherein at least a majority of said plunger is configured to be immersed in fluid in said bore when said plunger is in said valve closed position.

2. The faucet as recited in claim 1, further comprising a flow-modifying tip disposed on said downstream end of said plunger, said tip extending at least partially into said outlet port when said plunger is in said valve-open position.

3. The faucet as recited in claim 2, wherein said flow modifying tip is integral with said plunger.

4. The faucet as recited in claim 2, wherein said flow modifying tip is substantially cylindrical.

5. The faucet as recited in claim 1, wherein said plunger is at least essentially entirely immersed in fluid during fluid dispensation and during periods of non-use.

6. The faucet as recited in claim 1, further comprising a handle having a pivotal lever which terminates within said plunger, said lever being configured to drive said plunger to move axially within said bore upon pivotal movement of said lever.

7. The faucet as recited in claim 6, wherein said faucet is configured to dispense a liquid, and wherein said plunger is fluted to permit an exterior surface of said plunger to be washed with liquid flowing over said plunger.

8. The faucet as recited in claim 1, wherein said extension is of reduced diameter when compared to that of at least a central portion of said valve body.

9. The faucet as recited in claim 8, wherein said downstream portion of said passage in said shank tapers radially outwardly toward a downstream end thereof; and wherein said extension of said plunger tapers radially inwardly toward said upstream end thereof at in a manner that at least generally matches the taper of said downstream portion of said passage in said shank.

10. The faucet as recited in claim 9, wherein said extension of said plunger is generally circular in transverse cross section and is tapered so as to decrease progressively in diameter from a maximum diameter at said downstream end thereof to a tip at said upstream end thereof.

11. The faucet as recited in claim 1, wherein the plunger is at least generally square when viewed in transverse cross-section.

12. A faucet comprising:

(A) a valve body having a bore that has axially aligned inlet and outlet ports and having a seat disposed adjacent said outlet port;

(B) a plunger disposed in said valve body between said inlet port and said outlet port, wherein said plunger has an upstream end and a downstream, free end, and wherein said plunger is moveable axially within said bore, in a direction parallel to fluid flow, from a valve-open position to a valve-closed position;

(C) a valve seal mounted on said plunger, wherein said seal seals against said seat when said plunger is in said valve-closed position and is spaced from said seat when said plunger is in said valve-open position, and wherein at least a majority of said plunger is configured to be immersed in fluid in said bore when said plunger is in said valve closed position; and (D) a flow-modifying tip disposed on said downstream end of said plunger, said tip extending at least partially into said outlet port when said plunger is in said valve-open position, and wherein said flow modifying tip has a larger diameter at its upstream end and a smaller diameter at its downstream end.

13. The faucet as recited in claim 12, wherein said flow modifying tip is substantially conical.

14. The faucet as recited in claim 12 wherein said flow modifying tip has a flange at said upstream and is conical at said downstream end.

15. The faucet as recited in claim 12 wherein said flow modifying tip is substantially bulbous.

16. A faucet comprising:

(A) a valve body having a fluid source connection portion containing an inlet and an integral downward turning spigot connection portion containing an outlet;

(B) a shank to which said valve body is connected, said shank having an inlet, an outlet opening into said inlet of said valve body, and an interior passage having a downstream portion that terminates at said outlet of said shank and that is radially aligned with and that opens into said inlet port of said valve body, said downstream portion tapering radially outwardly toward a downstream end thereof;

(C) a horizontally-oriented bore within said body, wherein an inlet port is formed from an upstream end of said bore and an outlet port is formed from a downstream end of said bore, and wherein said inlet port and said outlet port are axially aligned with one another;

(D) a plunger disposed within said valve body between said inlet and outlet ports, said plunger having an upstream end and a downstream end, wherein said plunger is moveable axially within said bore, in a direction parallel to fluid flow, from a valve-open position to a valve-closed position, and wherein at least a majority of said plunger is configured to be immersed in fluid in said bore when said plunger is in said valve closed position, an extension being located on said upstream end of said plunger and extending into said downstream portion of said passage in said shank when said plunger is in both said valve-open position and said valve-closed position, said extension being of reduced diameter when compared to that of at least a central portion of said valve body and having a free upstream end, said extension tapering radially inwardly toward said upstream end thereof at in a manner that at least generally matches the taper of said downstream portion of said passage in said shank;

(E) a flow modifying tip that is disposed on said downstream end of said plunger that extends at least partially into said outlet port when said plunger is in said valve-open position;

(F) a valve seal disposed on said plunger in the vicinity of said downstream end thereof; and (G) a valve seat between said inlet and outlet ports, wherein said valve seal seals against said seat when said plunger is in said valve-closed position and is spaced from said seat when said plunger is in said valve-open position.

17. The faucet as recited in claim 16, wherein said extension of said plunger is generally circular in transverse cross section and is tapered so as to decrease progressively in diameter from a maximum diameter at said downstream end thereof to a tip at said upstream end thereof.

18. The faucet as recited in claim 16, wherein the plunger is at least generally square when viewed in transverse cross-section.

* * * * *